US008898988B2

(12) United States Patent
Pervan

(10) Patent No.: US 8,898,988 B2
(45) Date of Patent: Dec. 2, 2014

(54) MECHANICAL LOCKING SYSTEM FOR FLOOR PANELS

(71) Applicant: Valinge Innovation AB, Viken (SE)

(72) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 14/011,042

(22) Filed: Aug. 27, 2013

(65) Prior Publication Data

US 2014/0020324 A1 Jan. 23, 2014

Related U.S. Application Data

(63) Continuation of application No. 12/977,399, filed on Dec. 23, 2010, now Pat. No. 8,544,230.

(60) Provisional application No. 61/294,217, filed on Jan. 12, 2010.

(51) Int. Cl.

| | |
|---|---|
| ***E04B 2/00*** | (2006.01) |
| ***E04F 15/10*** | (2006.01) |
| ***E04F 15/04*** | (2006.01) |
| ***E04C 2/40*** | (2006.01) |

(52) U.S. Cl.

CPC . *E04C 2/40* (2013.01); *E04F 15/10* (2013.01); *E04F 15/04* (2013.01); *E04F 2201/0138* (2013.01); *E04F 2201/0523* (2013.01)

USPC ..... 52/582.1; 52/391; 52/588.1; 428/50

(58) Field of Classification Search

USPC ..... 52/390, 392, 533, 534, 539, 553, 578, 52/582.1, 586.1, 586.2, 588.1, 589.1, 52/590.2, 590.3, 591.1, 591.2, 591.3, 52/591.4, 591.5, 592.1, 592.2, 592.4, 52/745.08, 745.19, 747.1, 747.11, 748.1, 52/748.11; 403/334, 345, 364–368, 372, 403/375, 376, 381; 404/34, 35, 40, 41, 46, 404/47, 49–58, 68, 70; 428/44, 47–50, 57, 428/58, 60, 61, 106, 192–194

See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

Pervan, Darko, et al., U.S. Appl. No. 14/138,330 entitled "Mechanical Locking System for Floor Panels," filed in the U.S. Patent and Trademark Office on Dec. 23, 2013.

(Continued)

*Primary Examiner* — William Gilbert

(74) *Attorney, Agent, or Firm* — Buchanan Ingersoll & Rooney P.C.

(57) ABSTRACT

Floor panels (1*b*, 1*c*) provided with a mechanical locking system made of a separate material in order to reduce snapping resistance during vertical displacement.

18 Claims, 7 Drawing Sheets

(56) References Cited

U.S. PATENT DOCUMENTS

| | | | |
|---|---|---|---|
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,266,464 | A | 12/1941 | Kraft |
| 2,277,758 | A | 3/1942 | Hawkins |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,858,584 | A | 11/1958 | Gaines |
| 2,863,185 | A | 12/1958 | Riedi |
| 2,865,058 | A | 12/1958 | Andersson |
| 2,889,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,271,787 | A | 9/1966 | Clary |
| 3,325,585 | A | 6/1967 | Brenneman |
| 3,331,180 | A | 7/1967 | Vissing et al. |
| 3,378,958 | A | 4/1968 | Parks et al. |
| 3,396,640 | A | 8/1968 | Fujihara |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,572,224 | A | 3/1971 | Perry |
| 3,579,941 | A | 5/1971 | Tibbals |
| 3,720,027 | A | 3/1973 | Christensen |
| 3,722,379 | A | 3/1973 | Koester |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 3,994,609 | A | 11/1976 | Puccio |
| 4,007,994 | A | 2/1977 | Brown |
| 4,030,852 | A | 6/1977 | Hein |
| 4,037,377 | A | 7/1977 | Howell et al. |
| 4,041,665 | A | 8/1977 | de Munck |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,107,892 | A | 8/1978 | Bellem |
| 4,113,399 | A | 9/1978 | Hansen, Sr. et al. |
| 4,169,688 | A | 10/1979 | Toshio |
| 4,196,554 | A | 4/1980 | Anderson |
| 4,227,430 | A | 10/1980 | Janssen et al. |
| 4,299,070 | A | 11/1981 | Oltmanns |
| 4,304,083 | A | 12/1981 | Anderson |
| 4,426,820 | A | 1/1984 | Terbrack |
| 4,447,172 | A | 5/1984 | Galbreath |
| 4,599,841 | A | 7/1986 | Haid |
| 4,648,165 | A | 3/1987 | Whitehorne |
| 5,007,222 | A | 4/1991 | Raymond |
| 5,071,282 | A | 12/1991 | Brown |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,344,700 | A | 9/1994 | McGath et al. |
| 5,348,778 | A | 9/1994 | Knipp et al. |
| 5,373,674 | A | 12/1994 | Winter, IV |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,598,682 | A | 2/1997 | Haughian |
| 5,618,602 | A | 4/1997 | Nelson |
| 5,634,309 | A | 6/1997 | Polen |
| 5,658,086 | A | 8/1997 | Brokaw et al. |
| 5,694,730 | A | 12/1997 | Del Rincon et al. |
| 5,755,068 | A | 5/1998 | Ormiston |
| 5,899,038 | A | 5/1999 | Stroppiana |
| 5,950,389 | A | 9/1999 | Porter |
| 5,970,675 | A | 10/1999 | Schray |
| 6,006,486 | A | 12/1999 | Moriau |
| 6,029,416 | A | 2/2000 | Andersson |
| 6,052,960 | A | 4/2000 | Yonemura |
| 6,065,262 | A | 5/2000 | Motta |
| 6,173,548 | B1 | 1/2001 | Hamar et al. |
| 6,314,701 | B1 | 11/2001 | Meyerson |
| 6,345,481 | B1 | 2/2002 | Nelson |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,449,918 | B1 | 9/2002 | Nelson |
| 6,490,836 | B1 | 12/2002 | Moriau et al. |
| 6,505,452 | B1 | 1/2003 | Hannig |
| 6,553,724 | B1 | 4/2003 | Bigler |
| 6,591,568 | B1 | 7/2003 | Pålsson |
| 6,601,359 | B2 | 8/2003 | Olofsson |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,651,400 | B1 | 11/2003 | Murphy |
| 6,670,019 | B2 | 12/2003 | Andersson |
| 6,685,391 | B1 | 2/2004 | Gideon |
| 6,763,643 | B1 | 7/2004 | Martensson |
| 6,766,622 | B1 | 7/2004 | Thiers |
| 6,769,219 | B2 | 8/2004 | Schwitte et al. |
| 6,769,835 | B2 | 8/2004 | Stridsman |
| 6,804,926 | B1 | 10/2004 | Eisermann |
| 6,808,777 | B2 | 10/2004 | Andersson et al. |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,880,307 | B2 | 4/2005 | Schwitte et al. |
| 6,948,716 | B2 | 9/2005 | Drouin |
| 7,021,019 | B2 | 4/2006 | Knauseder |
| 7,040,068 | B2 | 5/2006 | Moriau et al. |
| 7,051,486 | B2 | 5/2006 | Pervan |
| 7,108,031 | B1 | 9/2006 | Secrest |
| 7,121,058 | B2 | 10/2006 | Pålsson |
| 7,152,383 | B1 | 12/2006 | Wilkinson et al. |
| 7,188,456 | B2 | 3/2007 | Knauseder |
| 7,219,392 | B2 | 5/2007 | Mullet et al. |
| 7,251,916 | B2 | 8/2007 | Konzelmann et al. |
| 7,257,926 | B1 | 8/2007 | Kirby |
| 7,337,588 | B1 | 3/2008 | Moebus |
| 7,377,081 | B2 | 5/2008 | Ruhdorfer |
| 7,451,578 | B2 | 11/2008 | Hannig |
| 7,454,875 | B2 | 11/2008 | Pervan et al. |
| 7,516,588 | B2 | 4/2009 | Pervan |
| 7,517,427 | B2 | 4/2009 | Sjoberg et al. |
| 7,533,500 | B2 | 5/2009 | Morton et al. |
| 7,556,849 | B2 | 7/2009 | Thompson et al. |
| 7,568,322 | B2 | 8/2009 | Pervan |
| 7,584,583 | B2 | 9/2009 | Bergelin et al. |
| 7,614,197 | B2 | 11/2009 | Nelson |
| 7,617,651 | B2 | 11/2009 | Grafenauer |
| 7,621,092 | B2 | 11/2009 | Groeke et al. |
| 7,634,884 | B2 | 12/2009 | Pervan |
| 7,637,068 | B2 | 12/2009 | Pervan |
| 7,654,055 | B2 | 2/2010 | Ricker |
| 7,677,005 | B2 | 3/2010 | Pervan |
| 7,716,889 | B2 | 5/2010 | Pervan |
| 7,721,503 | B2 | 5/2010 | Pervan et al. |

(56) References Cited

U.S. PATENT DOCUMENTS

| | | | |
|---|---|---|---|
| 7,726,088 | B2 | 6/2010 | Muehlebach |
| 7,757,452 | B2 | 7/2010 | Pervan |
| 7,802,411 | B2 | 9/2010 | Pervan |
| 7,806,624 | B2 | 10/2010 | McLean et al. |
| 7,841,144 | B2 | 11/2010 | Pervan et al. |
| 7,841,145 | B2 | 11/2010 | Pervan et al. |
| 7,841,150 | B2 | 11/2010 | Pervan |
| 7,856,789 | B2 | 12/2010 | Eisermann |
| 7,861,482 | B2 | 1/2011 | Pervan et al. |
| 7,866,110 | B2 | 1/2011 | Pervan |
| 7,908,815 | B2 | 3/2011 | Pervan et al. |
| 7,930,862 | B2 | 4/2011 | Bergelin et al. |
| 7,980,039 | B2 | 7/2011 | Groeke |
| 7,980,041 | B2 | 7/2011 | Pervan |
| 8,033,074 | B2 | 10/2011 | Pervan |
| 8,042,311 | B2 | 10/2011 | Pervan |
| 8,061,104 | B2 | 11/2011 | Pervan |
| 8,079,196 | B2 | 12/2011 | Pervan |
| 8,112,967 | B2 | 2/2012 | Pervan et al. |
| 8,171,692 | B2 | 5/2012 | Pervan |
| 8,181,416 | B2 | 5/2012 | Pervan et al. |
| 8,191,334 | B2 | 6/2012 | Braun |
| 8,234,830 | B2 | 8/2012 | Pervan et al. |
| 8,281,549 | B2 | 10/2012 | Du |
| 8,302,367 | B2 | 11/2012 | Schulte |
| 8,336,272 | B2 | 12/2012 | Prager et al. |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,805 | B2 | 1/2013 | Pervan et al. |
| 8,381,477 | B2 | 2/2013 | Pervan et al. |
| 8,387,327 | B2 | 3/2013 | Pervan |
| 8,448,402 | B2 | 5/2013 | Pervan et al. |
| 8,499,521 | B2 | 8/2013 | Pervan et al. |
| 8,505,257 | B2 | 8/2013 | Boo et al. |
| 8,511,031 | B2 | 8/2013 | Bergelin et al. |
| 8,528,289 | B2 | 9/2013 | Pervan et al. |
| 8,544,230 | B2 | 10/2013 | Pervan |
| 8,544,234 | B2 | 10/2013 | Pervan et al. |
| 8,572,922 | B2 | 11/2013 | Pervan |
| 8,578,675 | B2 | 11/2013 | Palsson et al. |
| 8,596,013 | B2 | 12/2013 | Boo |
| 8,615,952 | B2 | 12/2013 | Engström |
| 8,627,862 | B2 | 1/2014 | Pervan et al. |
| 8,631,623 | B2 | 1/2014 | Engström |
| 8,640,424 | B2 | 2/2014 | Pervan et al. |
| 8,650,826 | B2 | 2/2014 | Pervan et al. |
| 8,677,714 | B2 | 3/2014 | Pervan |
| 8,689,512 | B2 | 4/2014 | Pervan |
| 8,707,650 | B2 | 4/2014 | Pervan et al. |
| 8,733,065 | B2 | 5/2014 | Pervan |
| 8,733,410 | B2 | 5/2014 | Pervan |
| 8,763,341 | B2 | 7/2014 | Pervan |
| 8,769,905 | B2 | 7/2014 | Pervan |
| 8,776,473 | B2 | 7/2014 | Pervan et al. |
| 2001/0024707 | A1 | 9/2001 | Andersson et al. |
| 2002/0031646 | A1 | 3/2002 | Chen et al. |
| 2002/0069611 | A1 | 6/2002 | Leopolder |
| 2002/0092263 | A1 | 7/2002 | Schulte |
| 2002/0170258 | A1 | 11/2002 | Schwitte et al. |
| 2002/0170259 | A1 | 11/2002 | Ferris |
| 2002/0178674 | A1 | 12/2002 | Pervan |
| 2002/0178680 | A1 | 12/2002 | Martensson |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0084636 | A1 | 5/2003 | Pervan |
| 2003/0094230 | A1 | 5/2003 | Sjoberg |
| 2003/0101681 | A1 | 6/2003 | Tychsen |
| 2003/0145549 | A1 | 8/2003 | Palsson et al. |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0031227 | A1 | 2/2004 | Knauseder |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0123548 | A1 | 7/2004 | Gimpel et al. |
| 2004/0128934 | A1 | 7/2004 | Hecht |
| 2004/0139676 | A1 | 7/2004 | Knauseder |
| 2004/0139678 | A1 | 7/2004 | Pervan |
| 2004/0159066 | A1 | 8/2004 | Thiers et al. |
| 2004/0168392 | A1 | 9/2004 | Konzelmann et al. |
| 2004/0177584 | A1 | 9/2004 | Pervan |
| 2004/0182033 | A1 | 9/2004 | Wernersson |
| 2004/0182036 | A1 | 9/2004 | Sjoberg et al. |
| 2004/0200175 | A1 | 10/2004 | Weber |
| 2004/0211143 | A1* | 10/2004 | Hanning ..... 52/578 |
| 2004/0250492 | A1 | 12/2004 | Becker |
| 2004/0261348 | A1 | 12/2004 | Vulin |
| 2005/0003132 | A1 | 1/2005 | Blix et al. |
| 2005/0028474 | A1 | 2/2005 | Kim |
| 2005/0050827 | A1 | 3/2005 | Schitter |
| 2005/0160694 | A1 | 7/2005 | Pervan |
| 2005/0166514 | A1 | 8/2005 | Pervan |
| 2005/0205161 | A1 | 9/2005 | Lewark |
| 2005/0210810 | A1 | 9/2005 | Pervan |
| 2005/0235593 | A1 | 10/2005 | Hecht |
| 2006/0053724 | A1 | 3/2006 | Braun et al. |
| 2006/0070333 | A1 | 4/2006 | Pervan |
| 2006/0101769 | A1 | 5/2006 | Pervan et al. |
| 2006/0156670 | A1 | 7/2006 | Knauseder |
| 2006/0236642 | A1 | 10/2006 | Pervan |
| 2006/0260254 | A1 | 11/2006 | Pervan |
| 2007/0006543 | A1 | 1/2007 | Engstrom |
| 2007/0011981 | A1 | 1/2007 | Eisermann |
| 2007/0028547 | A1 | 2/2007 | Grafenauer |
| 2007/0065293 | A1 | 3/2007 | Hannig |
| 2007/0108679 | A1 | 5/2007 | Grothaus |
| 2007/0151189 | A1 | 7/2007 | Yang et al. |
| 2007/0175156 | A1 | 8/2007 | Pervan et al. |
| 2007/0193178 | A1 | 8/2007 | Groeke et al. |
| 2007/0209736 | A1 | 9/2007 | Deringor et al. |
| 2007/0214741 | A1 | 9/2007 | Llorens Miravet |
| 2008/0000185 | A1 | 1/2008 | Duernberger |
| 2008/0000186 | A1 | 1/2008 | Pervan et al. |
| 2008/0000187 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan |
| 2008/0155930 | A1 | 7/2008 | Pervan et al. |
| 2008/0216920 | A1 | 9/2008 | Pervan |
| 2008/0236088 | A1 | 10/2008 | Hannig et al. |
| 2008/0295432 | A1 | 12/2008 | Pervan et al. |
| 2009/0019806 | A1 | 1/2009 | Muehlebach |
| 2009/0100782 | A1 | 4/2009 | Groeke et al. |
| 2009/0133353 | A1 | 5/2009 | Pervan et al. |
| 2009/0151290 | A1 | 6/2009 | Liu |
| 2009/0193741 | A1 | 8/2009 | Capelle |
| 2009/0193748 | A1 | 8/2009 | Boo et al. |
| 2009/0193753 | A1 | 8/2009 | Schitter |
| 2009/0308014 | A1 | 12/2009 | Muehlebach |
| 2010/0043333 | A1* | 2/2010 | Hannig ..... 52/582.2 |
| 2010/0083603 | A1 | 4/2010 | Goodwin |
| 2010/0173122 | A1 | 7/2010 | Susnjara |
| 2010/0281803 | A1 | 11/2010 | Cappelle |
| 2010/0293879 | A1 | 11/2010 | Pervan et al. |
| 2010/0300029 | A1 | 12/2010 | Braun et al. |
| 2010/0300031 | A1 | 12/2010 | Pervan et al. |
| 2010/0319290 | A1 | 12/2010 | Pervan |
| 2010/0319291 | A1 | 12/2010 | Pervan et al. |
| 2011/0016815 | A1 | 1/2011 | Yang |
| 2011/0030303 | A1 | 2/2011 | Pervan et al. |
| 2011/0041996 | A1 | 2/2011 | Pervan |
| 2011/0047922 | A1 | 3/2011 | Fleming, III |
| 2011/0088344 | A1 | 4/2011 | Pervan et al. |

(56) References Cited

U.S. PATENT DOCUMENTS

| | | | |
|---|---|---|---|
| 2011/0088345 | A1 | 4/2011 | Pervan |
| 2011/0131916 | A1 | 6/2011 | Chen |
| 2011/0154763 | A1 | 6/2011 | Bergelin et al. |
| 2011/0167750 | A1 | 7/2011 | Pervan |
| 2011/0167751 | A1 | 7/2011 | Engstrom |
| 2011/0197535 | A1 | 8/2011 | Baker et al. |
| 2011/0225922 | A1 | 9/2011 | Pervan et al. |
| 2011/0252733 | A1 | 10/2011 | Pervan |
| 2011/0271632 | A1 | 11/2011 | Cappelle et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0096801 | A1 | 4/2012 | Cappelle |
| 2012/0124932 | A1 | 5/2012 | Schulte et al. |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0174521 | A1 | 7/2012 | Schulte et al. |
| 2012/0192521 | A1 | 8/2012 | Schulte |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0019555 | A1 | 1/2013 | Pervan |
| 2013/0036695 | A1 | 2/2013 | Durnberger |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160391 | A1 | 6/2013 | Pervan et al. |
| 2013/0232905 | A2 | 9/2013 | Pervan |
| 2013/0239508 | A1 | 9/2013 | Darko et al. |
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0033634 | A1 | 2/2014 | Pervan |
| 2014/0053497 | A1 | 2/2014 | Pervan et al. |
| 2014/0069043 | A1 | 3/2014 | Pervan |
| 2014/0090335 | A1 | 4/2014 | Pervan et al. |
| 2014/0109501 | A1 | 4/2014 | Darko |
| 2014/0109506 | A1 | 4/2014 | Pervan et al. |
| 2014/0123586 | A1 | 5/2014 | Pervan et al. |
| 2014/0190112 | A1 | 7/2014 | Pervan |

FOREIGN PATENT DOCUMENTS

| | | | |
|---|---|---|---|
| DE | 39 32 980 | A1 | 11/1991 |
| DE | 299 22 649 | U1 | 4/2000 |
| DE | 200 01 788 | U1 | 6/2000 |
| DE | 199 40 837 | A1 | 11/2000 |
| DE | 10 2009 048 050 | B3 | 1/2001 |
| DE | 199 58 225 | A1 | 6/2001 |
| DE | 202 05 774 | | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 054 368 | A1 | 5/2006 |
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| EP | 0 013 852 | A1 | 8/1980 |
| EP | 0 871 156 | A2 | 10/1998 |
| EP | 0 974 713 | A1 | 1/2000 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-288017 | A | 10/1994 |
| JP | 6-306961 | A | 11/1994 |
| JP | 6-322848 | A | 11/1994 |
| JP | 7-300979 | A | 11/1995 |
| WO | WO 94/26999 | A1 | 11/1994 |
| WO | WO 97/47834 | A1 | 12/1997 |
| WO | WO 98/22677 | A1 | 5/1998 |
| WO | WO 00/20705 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 03/016654 | A1 | 2/2003 |
| WO | WO 03/025307 | A1 | 3/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 4/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2007/141605 | A2 | 8/2007 |
| WO | WO 2007/118352 | A1 | 10/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2009/116926 | A1 | 9/2009 |
| WO | WO 2010/006684 | A2 | 1/2010 |
| WO | WO 2008/068245 | A1 | 6/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/108980 | A1 | 9/2010 |
| WO | WO 2010/136171 | A1 | 12/2010 |

(56) References Cited

FOREIGN PATENT DOCUMENTS

| | | | |
|---|---|---|---|
| WO | WO 2011/001326 | A2 | 1/2011 |
| WO | WO 2011/012104 | A2 | 2/2011 |
| WO | WO 2011/032540 | A2 | 3/2011 |
| WO | WO 2011/127981 | A1 | 10/2011 |
| WO | WO 2011/151758 | A2 | 12/2011 |

OTHER PUBLICATIONS

Pervan, Darko, U.S. Appl. No. 14/138,385 entitled "Mechanical Locking System for Panels and Method of Installing Same," filed in the U.S. Patent and Trademark Office on Dec. 23, 2013.

Pervan, Darko, et al., U.S. Appl. No. 14/152,402 entitled "Mechanical Locking System for Floor Panels," filed in the U.S. Patent and Trademark Office on Jan. 10, 2014.

Pervan, Darko, et al., U.S. Appl. No. 13/962,446, entitled "Mechanical Locking System for Floor Panels," filed in the U.S. Patent and Trademark Office on Aug. 8, 2013.

Pervan, Darko, U.S. Appl. No. 14/042,887 entitled "Mechanical Locking of Floor Panels with a Glued Tongue," filed in the U.S. Patent and Trademark Office on Oct. 1, 2013.

Pervan, Darko, U.S. Appl. No. 14/046,235 entitled "Mechanical Locking of Floor Panels with a Flexible Tongue,"filed in the U.S. Patent and Trademark Office on Oct. 4, 2013.

Nygren, Per, et al., U.S. Appl. No. 61/774,749, entitled "Building Panels Provided with a Mechanical Locking System," filed in the U.S. Patent and Trademark Office on Mar. 8, 2013.

International Search Report mailed Apr. 15, 2011 in PCT/SE2010/051479, Swedish Patent Office, Stockholm, Sweden, 6 pages.

Välinge Innovation AB, Technical Disclosure entitled "Mechanical locking for floor panels with a flexible bristle tongue," IP.com number: IPCOM000145262D, Jan. 12, 2007, IP.com PriorArtDatabase, 57 pages.

Engstrand, Ola (Contact)/Välinge Innovation AB, Technical Disclosure entitled "VA-038 Mechanical Locking of Floor Panels With Vertical Folding," IP com number: IPCOM000179246D, Feb. 10, 2009, IP.com Prior Art Database, 59 pages.

Engstrand, Ola (Contact)/Välinge Innovation AB, Technical Disclosure entitled "VA043 5G Linear Slide Tongue," IP com number: IPCOM000179015D, Feb. 4, 2009, IP.com Prior Art Database, 126 pages.

Engstrand, Ola (Owner)/Välinge Innovation AB, Technical Disclosure entitled "VA043b PCT Mechanical Locking of Floor Panels," IP com number: IPCOM000189420D, Nov. 9, 2009, IP.com Prior Art Database, 62 pages.

Laminate Flooring Tips (http://flooring.lifetips.com/cat/61734/laminate-flooring-tips/index.html). Copyright 2000. 12 pages.

Pervan, Darko, U.S. Appl. No. 14/080,105 entitled "Mechanical Locking of Floor Panels with Vertical Folding," filed in the U.S. Patent and Trademark Office on Nov. 14, 2013.

Pervan, Darko, et al., U.S. Appl. No. 14/095,052, entitled "Mechanical Locking of Floor Panels," filed in the U.S. Patent and Trademark Office on Dec. 3, 2013.

Pervan, Darko, et al., U.S. Appl. No. 14/206,286, entitled "Mechanical Locking System for Panels and Method of Installing Same," filed in the U.S. Patent and Trademark Office on Mar. 12, 2014.

Pervan, Darko, U.S. Appl. No. 14/270,711, entitled "Mechanical Locking System for Floor Panels," filed in the U.S. Patent and Trademark Office on May 6, 2014.

Pervan, Darko, et al., U.S. Appl. No. 14/294,230, entitled "Mechanical Locking System for Floor Panels," filed in the U.S. Patent and Trademark Office of Jun. 3, 2014.

Pervan, Darko, U.S. Appl. No. 14/294,623, entitled "Mechanical Locking of Floor Panels with Vertical Folding," filed in the U.S. Patent and Trademark Office on Jun. 3, 2014.

Boo, Christian, U.S. Appl. No. 14/315,879, entitled "Building Panel With a Mechanical Locking System," filed in the U.S. Patent and Trademark Office on Jun. 26, 2014.

* cited by examiner 1c
1b
VP
31
30

VP
1c
1b
31
14
P
30
T1
32
6
8

1a
1c
1b 1c
1b
14
31
30
33
6
8

MECHANICAL LOCKING SYSTEM FOR FLOOR PANELS

CROSS REFERENCE TO RELATED APPLICATIONS

The present application is a continuation of U.S. application Ser. No. 12/997,399. Filed on Dec. 23, 2010, and claims the benefit of U.S. Provisional Application No. 61/294,217, filed on Jan. 12, 2010, and claims the benefit of Swedish Application No. 1050018-9, filed on Jan. 12, 2010. The entire contents of each of U.S. application Ser. No. 12/997,399, U.S. Provisional Application No. 61/294,217 and Swedish Application No. 1050018-9 are hereby incorporated herein by reference.

TECHNICAL FIELD

The invention generally relates to the field of mechanical locking systems for floor panels and building panels especially floor panels with mechanical locking systems, which are possible to lock with a vertical displacement.

FIELD OF APPLICATION OF THE INVENTION

Embodiments of the present invention are particularly suitable for use in floating floors, which are formed of floor panels which are joined mechanically with a locking system integrated with the floor panel, i.e. mounted at the factory, that are made up of one or more upper layers of veneer, decorative laminate or decorative plastic material, an intermediate core of wood fibre based material or plastic material and preferably a lower balancing layer on the rear side of the core. The following description of known technique, problems of known systems and objects and features of the invention will therefore, as a non-restrictive example, be aimed at this field of application and in particular at paper based or paper free laminate flooring formed as rectangular floor panels with long and shorts sides intended to be mechanically joined on both long and short sides. The long and short sides are mainly used to simplify the description of the invention. The panels can be squared and can have more than four sides, which are not parallel or perpendicular to each other.

It should be emphasized that embodiments of the invention can be applied to any floor panel and it could be combined with all types of known locking system, where the floor panels are intended to be joined using a mechanical locking system connecting the panels in the horizontal and vertical directions on at least two adjacent sides. The invention can thus also be applicable to, for instance, solid wooden floors, parquet floors with a core of wood or wood fibre based material and a surface of wood or wood veneer and the like, floors with a printed and preferably also varnished surface, floors with a surface layer of plastic or cork, linoleum, rubber or similar. Even floors with hard surfaces such as stone, tile and similar are included and floorings with soft wear layer, for instance needle felt glued to a board. Embodiments of the invention can also be used for joining building panels which preferably contain a board material for instance wall panels, ceilings, furniture components and similar.

BACKGROUND OF THE INVENTION

Laminate flooring usually comprising a core of 6-12 mm fibreboard, a 0.2-0.8 mm thick upper decorative surface layer of laminate and a 0.1-0.6 mm thick lower balancing layer of laminate, plastic, paper or like material. A laminate surface comprising a melamine impregnated paper. Recently printed surfaces and wood fibre based paper free laminate surfaces have been developed. The most common core material is a fibreboard with high density and good stability usually called HDF—High Density Fibreboard. Sometimes also MDF—Medium Density Fibreboard—is used as core.

Laminate floor panels are generally joined mechanically by means of so called mechanical locking systems. These systems comprise locking means, which lock the panels horizontally and vertically. The mechanical locking systems are usually formed by machining the core of the panel. Alternatively, parts of the locking system can be formed of separate materials, which are integrated with the floor panel, i.e. joined with the floor panel in connection with the manufacture thereof.

The main advantages of floating floors with mechanical locking systems are that they are easy to install. Preferably, they can also easily be taken up again and used once more at a different location.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane (HP) or principal plane" is meant a plane, which extends parallel to the outer part of the surface layer. Immediately juxtaposed upper parts of two adjacent joint edges of two joined floor panels together define a "vertical plane (VP)" perpendicular to the horizontal plane. By "horizontally" is meant parallel to the horizontal plane and by "vertically" parallel to the vertical plane. By "up or upwardly" is meant towards the front side and by "down or downwardly" is meant towards the rear side. By "inwardly" is meant essentially horizontally towards the inner part of the panel and by "outwardly is meant essentially horizontally and away from the inner part of the panel. By "strip panel" is meant a panel comprising a strip and a locking element. By "groove panel" is meant a panel with a locking groove intended to cooperate with a locking element for horizontal locking.

Known Technique and Problems Thereof

The description of the known art below is in applicable parts also used in embodiments of the invention.

For mechanical joining of long sides as well as short sides in the vertical and horizontal direction several methods and locking systems could be used. One of the most used methods is the angle-snap method and one of the most used locking systems is a system made in one piece with the core. The long sides are installed by angling. The panel is then displaced in locked position along the long side. The short sides are locked by horizontal snapping.

An alternative method is the so-called angling-angling method whereby long and short sides are locked with angling.

Recently a new and simpler method has been developed where all floor panels can be joined with just an angling of the long edges. This installation method generally referred to as "fold down" installation method is described in FIGS. 1-4. The locking of the short edges la, 1*b* takes place with a scissors like movement where a flexible tongue 31 is displaced inwardly gradually from one edge to the other edge when a long side of a panel 1*c* in one row is connected by angling to an adjacent panel 1*a* in a previously installed row. The flexible snap tab, which in most cases is made of a plastic section, is during folding bended horizontally along the joint. A part of the snap tab is during folding almost in a locked position, as shown in FIG. 1, and other parts are in contact with the adjacent edge, FIG. 2, or in an completely unlocked position, as shown in FIG. 4.

Some versions of flexible tongues which are generally made of an extruded plastic section have an inner part, which is connected in a holding groove 32 and an outer flexible snap tab pointing downwards 33 that during folding snaps into a tongue groove 31 of an adjacent panel 1*c*. The flexible tongue is generally connected to an edge of the strip panel. It could also be connected to the groove panel. The snap tab is in such a version extending upwards.

The main problem with known flexible tongue 30 as shown in FIG. 2 is that it is difficult to lock due to limited flexibility. The contact point P between the groove panel and the flexible snap tab 33 is at an upper part when the groove panel is folded down along the vertical plane VP. The snap tab is also rather rigid due to the fact that the vertical extension T1 is less than 0.3 times the floor thickness T. The snap tab is also pushed inwardly and intersects the vertical plane VP. The holding groove must be made rather large in order to provide stability and this is a disadvantage.

FIGS. 5*a* and 5*b* show a snap tab with improved flexibility. It has an inner part 30*a* and an outer part 30*b* that are flexible. The snap tab must be displaced in the holding groove during locking and this requires tight tolerances. The snap is displaced into the holding groove 32, which must have a considerable horizontally extending depth.

FIGS. 6*a* and 6*b* show a locking system on the market where the contact point P is on the upper part of the flexible snap tab, which is displaced inwardly beyond the vertical plane in order to improve flexibility. The groove must be rather deep and this effect the stability of the edge in a negative way.

FIGS. 6*c* and 6*d* show another locking system on the market, which is made of three parts, two rather rigid parts 30*a*, 30*b* and one flexible rubber like part 30*c*.

FIGS. 6*e*, 6*f* show a locking system with a simple cross section, which is schematically shown in WO 2007/079845, FIG. 22, where the flexible snap tab 33 is made of a narrow rectangular cross-section that is bent or curved shaped. The snap tab is bended outside the vertical plane. The disadvantage is that the vertical extension of the holding groove is very small and difficult to produce with rotating tools. The flexible tongue 30 is difficult to fix into the groove and has a limited flexibility. The main disadvantage is however that the snap tab is bent around a centre point CP that is in contact with the lower part of the groove 32. This will in most cases cause a breaker or a permanent bending in many materials especially an extruded plastic material. The embodiment combines three major disadvantages: a) a deep holding groove, b) limited flexibility of the snap tab and c) high snapping resistance.

All the shown known embodiments have snap tabs, which have a vertical extension T1 that is smaller than 0.3 times the floor thickness T, and this creates a considerable snapping resistance during folding especially if it is combined with contacts points P at the upper part of the snap tab.

The function of a locking system with a snap tab could be improved if flexibility of the snap tab could be increased and if the horizontal extension of the holding groove could be reduced.

BRIEF DESCRIPTION OF THE INVENTION AND OBJECTS THEREOF

An objective of certain embodiments of the present invention is to provide an improved mechanical locking system comprising a flexible tongue with an outer flexible snap tab, which could by locked by vertical folding.

More specifically the object is to provide a vertical snap locking system, which creates less snapping resistance and which has a more stable edge than the known systems.

The objective is to improve the stability of the edge mainly with holding grooves that allow a strong connection between a flexible tongue and the holding groove and that have a smaller horizontal extension inwardly into the core of the panel than present known systems.

The above objects of certain embodiments of the invention are achieved wholly or partly by a mechanical locking systems and floor panels, as described herein. Further embodiments of the invention are evident from the claims, description and drawings.

According to a first aspect of certain embodiments of the invention, a set of floor panels are provided which are mechanically connectable to each other along one pair of adjacent edges, so that upper joint edges of said floor panels in the connected state define a vertical plane. Each of said floor panels comprising a flexible tongue on a first edge of the panel and a tongue groove on a second opposite edge of the panel for receiving the flexible tongue of an adjacent panel for mechanically locking together said adjacent edges vertically parallel to the vertical plane and at right angles to a horizontal plane of the panels.

The tongue groove is formed in a core of the panel and is open towards the vertical plane. A locking element is formed in one piece with the panel at the first edge and a locking groove at the opposite second edge. The locking groove being open towards a rear side of the panel that faces a subfloor.

The locking element and the locking groove form a horizontal mechanical connection perpendicular to the vertical plane, the locking element having a locking surface that is adapted to directly contact a locking surface of the locking groove for locking the panels to each other horizontally parallel to the horizontal plane and at right angles to the joined first and second edges.

The flexible tongue comprises resilient parts formed of a separate material than the core, and cooperates with a locking surface in the tongue groove.

Wherein two of the panels can be mechanically joined together by displacement of said two panels vertically towards each other, while at least an outer part of the flexible tongue, comprising a flexible snap tab extending downwards is resiliently displaced inwardly, substantially around a centre point located at an upper part of the flexible tongue and spaced from the lower part of the holding groove, to an inner position which is outside the vertical plane, until said adjacent edges of the two panels are brought into engagement with each other vertically and the flexible snap tab is displaced towards its initial position away from the vertical plane and against the tongue groove.

The flexible tongue has an inner part mounted in a sideward open holding groove in the first edge that is open towards the vertical plane. The inner part is fixed in the sideward open holding groove.

The outer flexible part, e.g., the flexible snap tab, has a cross section with a maximum thickness of the outer flexible part (e.g., the flexible snap tab), and the locking surface being offset in relation to the vertical plane by at least the maximum thickness of the flexible snap tab.

According to a second aspect of certain embodiments of the invention, a set of floor panels are provided which are mechanically connectable to each other along one pair of adjacent edges, so that upper joint edges of said floor panels in the connected state define a vertical plane. Each of said floor panels comprising a flexible tongue on a first edge of the panel and a tongue groove on a second opposite edge of the panel for receiving the flexible tongue of an adjacent panel for mechanically locking together said adjacent edges vertically parallel to the vertical plane and at right angles to a horizontal plane of the panels.

The tongue groove is formed in a core of the panel and is open towards the vertical plane. A locking element is formed in one piece with the panel at the first edge and a locking groove at the opposite second edge. The locking groove being open towards a rear side of the panel that faces a subfloor.

The locking element and the locking groove form a horizontal mechanical connection perpendicular to the vertical plane, the locking element having a locking surface that is adapted to directly contact a locking surface of the locking groove for locking the panels to each other horizontally parallel to the horizontal plane and at right angles to the joined first and second edges.

The flexible tongue comprises resilient parts formed of a separate material than the core, and cooperates with a locking surface in the tongue groove.

Wherein two of the panels can be mechanically joined together by displacement of said two panels vertically towards each other, while at least an outer part of the flexible tongue, comprising a flexible snap tab extending downwards is resiliently displaced inwardly until said adjacent edges of the two panels are brought into engagement with each other vertically and the flexible snap tab is displaced towards its initial position away from the vertical plane and against the tongue groove.

The flexible tongue has an inner part mounted in a sideward open holding groove in the first edge that is open towards the vertical plane. The inner part is fixed in the sideward open holding groove.

The outer flexible part, e.g., the flexible snap tab, has a cross section with a maximum thickness of the outer flexible part (e.g., the flexible snap tab), and the locking surface being offset in relation to the vertical plane by at least the maximum thickness of the flexible snap tab.

The inner part comprises one or several vertical cross sections wherein one of said vertical cross sections may be larger than said thickness of the flexible snap tab and/or another vertical cross section of the inner part.

DESCRIPTION OF EMBODIMENTS OF THE INVENTION

To facilitate understanding, several locking systems in the figures are shown schematically. It should be emphasized that improved or different functions can be achieved using combinations of the preferred embodiments.

Figures 1, 2, 3, 4:
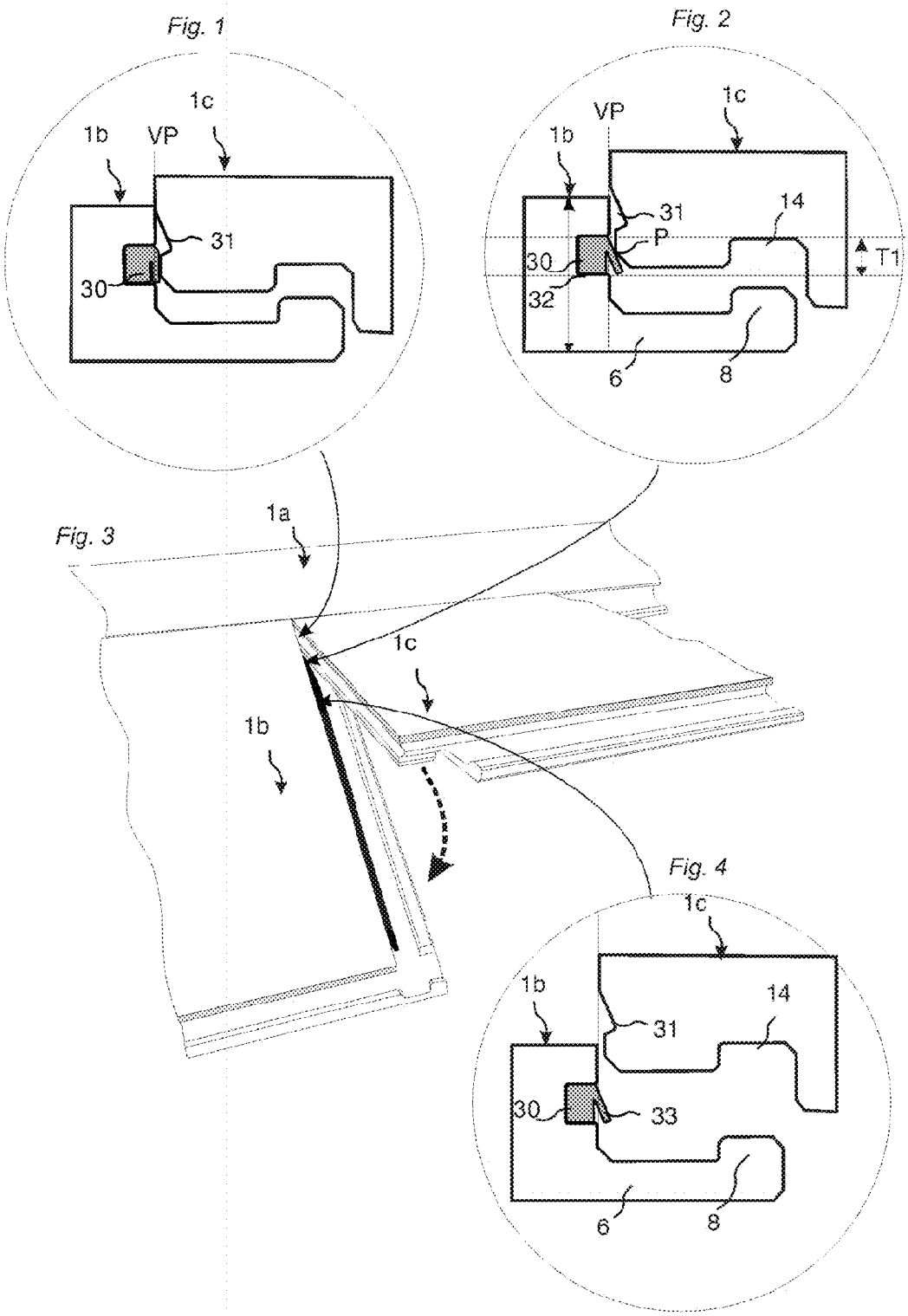
FIGS. 1-6*f* illustrate known systems.
Figure 5A:
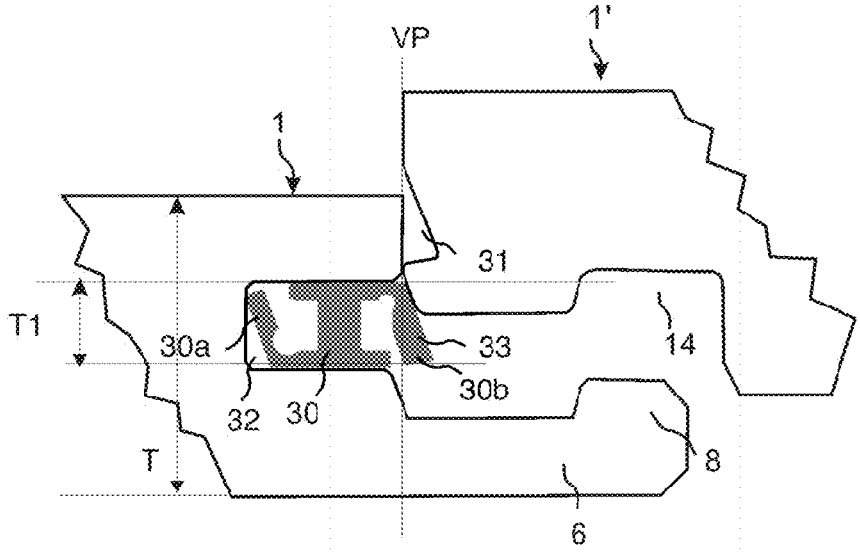
Figure 5B:
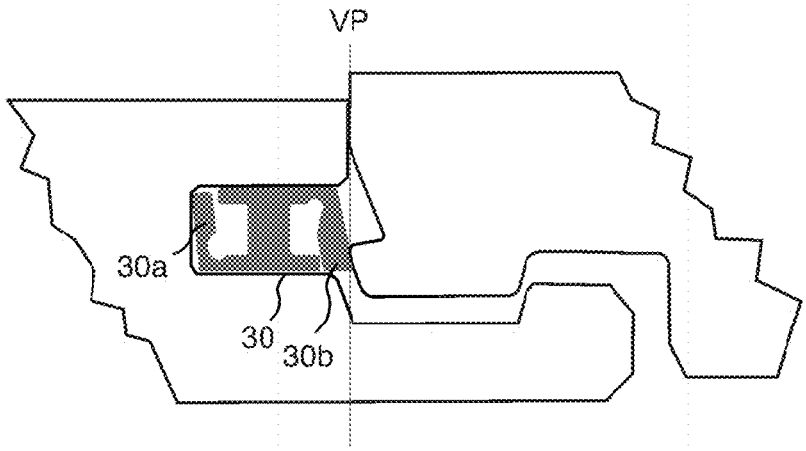
Figure 6A:
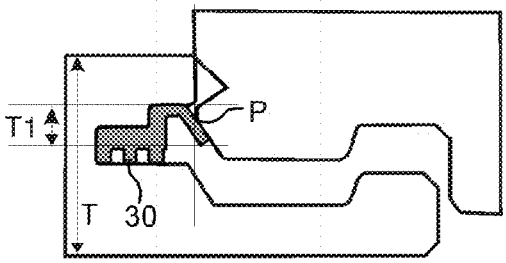
Figure 6C:
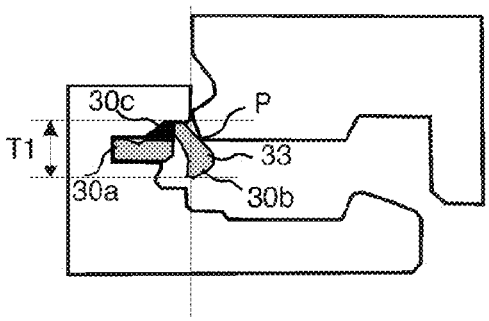
Figure 6B:
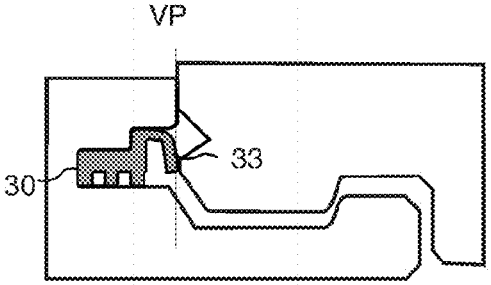
Figure 6D:
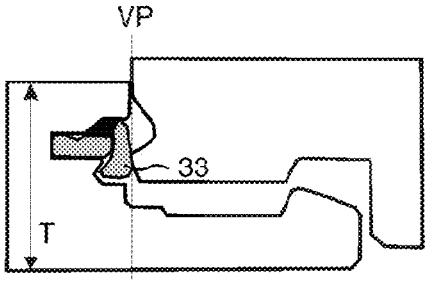
Figure 6E:
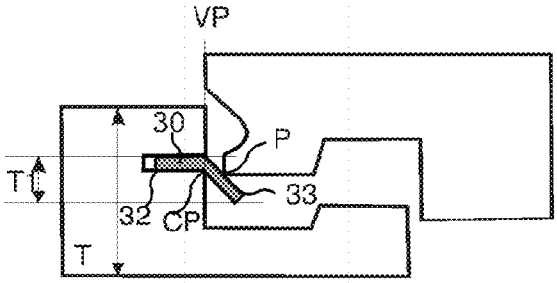
Figure 6F:
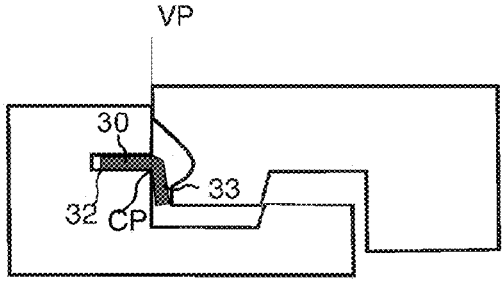
Figure 7A:
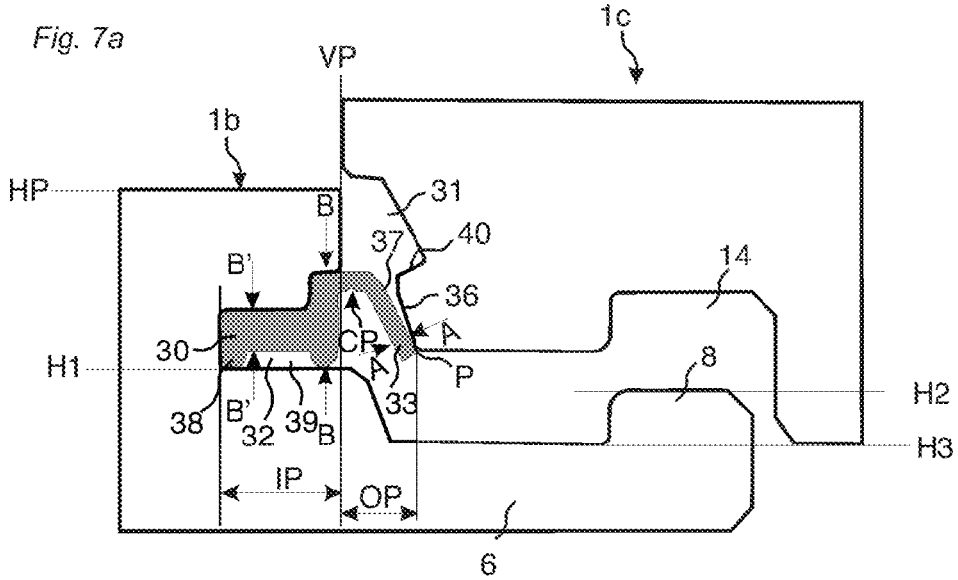
FIGS. 7*a*-7*c* illustrate a first embodiment of the invention.
Figure 7B:
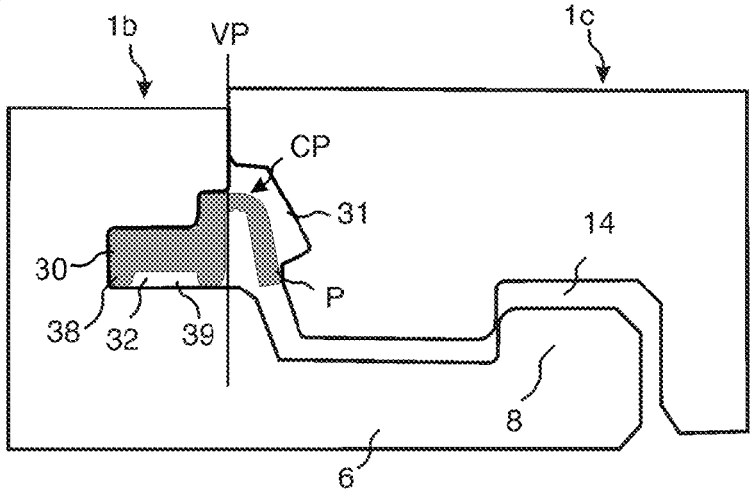
Figure 7C:
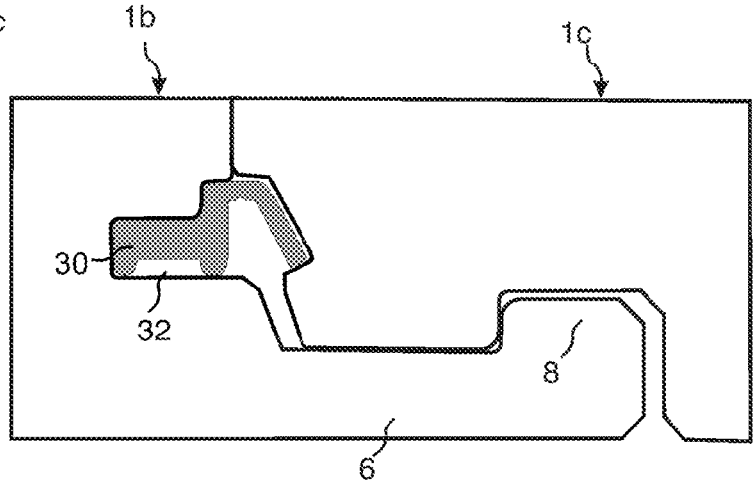

FIGS. 7*a*-7*c* show an embodiment of the invention. A strip panel 1*b* comprising a strip 6 and a locking element 8 which cooperates with a locking groove 14 in a groove panel 1*c* for horizontal locking of two adjacent edges of panels 1*b*, 1*c* is provided. The strip panel comprises a flexible tongue 30 in a holding groove 32, which is open towards the vertical plane VP and has an inner part IP connected to the holding groove. The flexible tongue has an outer part OP outside the vertical plane VP comprising a flexible snap tab 33 that cooperates with a locking surface 40 of a tongue groove 31 in an adjacent edge 1*c* of the groove panel 1*c* and locks the edges vertically parallel to the vertical plane VP.

The snap tab is during the whole locking motion positioned outside the vertical plane VP and is during locking displaced inwardly towards the vertical plane and outwardly away from the vertical plane as shown in FIGS. 7*b* and 7*c*. The snap tab is during the displacement bended around a centre point which is located at an upper part of the flexible tongue 30 and is preferably spaced vertically upwards from the lower part of the holding groove 32 and/or horizontally outwardly from the vertical plane VP. The snap tab is preferably spaced from the vertical plane in its inner position. The inner part of the snap tab could also preferably be aligned with the vertical pane.

Such an embodiment makes it possible to decrease the amount of material that has to be removed in order to form a holding groove. The horizontal extension of the holding groove 32 could be decreased and even the opening could be smaller. This improves the stability of the edge. The improved stability could be combined with a maintained or even improved flexibility of the snap tab.

The groove panel 1*c* comprises a lower part 36, which is preferably formed as a bevel, and preferably more vertically inclined than the outer part 37 of the flexible snap tab. The first contact point P between the groove panel 1*c* and the flexible tongue 30 is preferably located at the lower part of the flexible snap tab 33 when the groove panel 1*c* is displaced vertically along the vertical plane VP towards the strip panel 1*b*. Such an embodiment will decrease the snapping resistance considerably.

The lower part of the holding grove 32 is preferably located in a horizontal plane H1 which is vertically offset upwardly from a vertical plane H3 that intersects the upper part of the strip 6 and preferably also from a horizontal plane H2 that intersects the upper part of the locking element. This facilitates the fixing of the tongue into the holding groove. The holding grove could also be inclined upwardly from an inner to an outer position. This is an advantage, which could be used in all snap tab systems, such as the known art systems previously discussed, to facilitate the fixing of the flexible tongue. Embodiments of the known art systems previously discussed with an inclined holding groove are included within the scope of the invention.

The flexible tongue has preferably a thickness A-A at its outer part OP that is smaller than a vertical thickness B-B located in the inner part IP. The inner part IP of the flexible tongue 30 comprises preferably two vertical cross sections B-B, B'-B', with different vertical thicknesses and preferably a space 39 between a lower and/or upper part of the flexible groove. Such an embodiment makes it possible to combine a stable connection of the flexible tongue, to save material and to improve flexibility.

The locking surface 40 is offset to the vertical plane by at least the maximum thickness A-A of the flexible snap tab 33.

The inner part of the flexible tongue 30 can substantially fill the volume of the sideward open holding groove or can comprise one or several friction connection 38 that extends downwards and/or upwards.

The described motion of a flexible snap tab outside the vertical plane and a first contact point at a lower part of the snap tab could be used separately to improve locking but preferably in combination. It is an advantage to use a low contact point even in embodiments where the snap tab is displaced inwardly beyond the vertical plane.

Figure 8A:
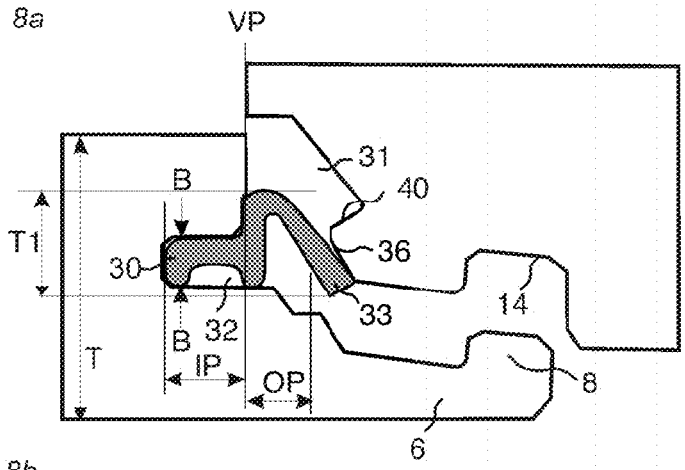
FIGS. 8*a*-8*d* illustrate a second embodiment of the invention.
Figure 8B:
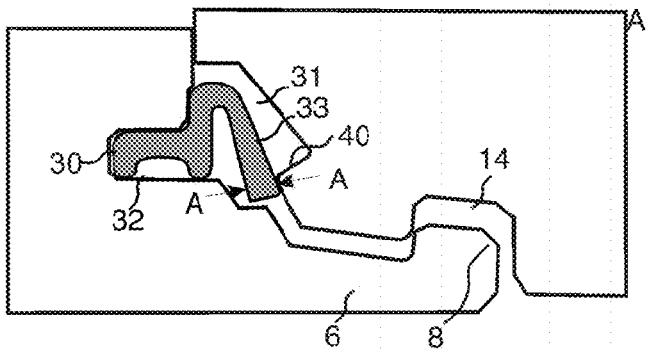
Figure 8C:
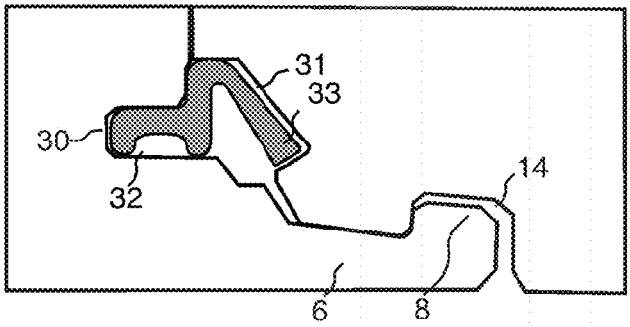

FIGS. 8*a*-8*c* show that the snap tab 33 could preferably be formed with a vertical extension T1 that is equal or larger than 0.3 times the floor thickness T. It is even more preferred to increase this vertical extension to 0.35 or even to more than 0.40 times the floor thickness T. This is especially preferable in wood floors where a high locking strength could be combined with an easy locking.

Such an embodiment could be used to decrease the locking resistance further especially if it is combined with one or both of the two other desired features described above.

Figure 8D:
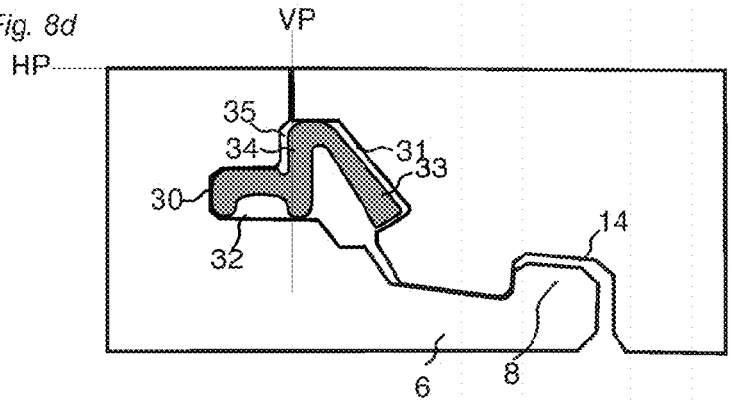

FIG. 8*d* shows an embodiment where the upper part 34 of the flexible tongue 30 can be bended horizontally inwardly, preferably to a position inside the vertical plane VP. When the upper part of the snap tab is in locked position, a space 35 exists between the flexible tongue and the holding groove 32. The upper part of the flexible tongue is displaced in the space 35 during locking. This can be used to reduce snapping resistance and to increase the flexibility of the flexible tongue.

Figure 9A:
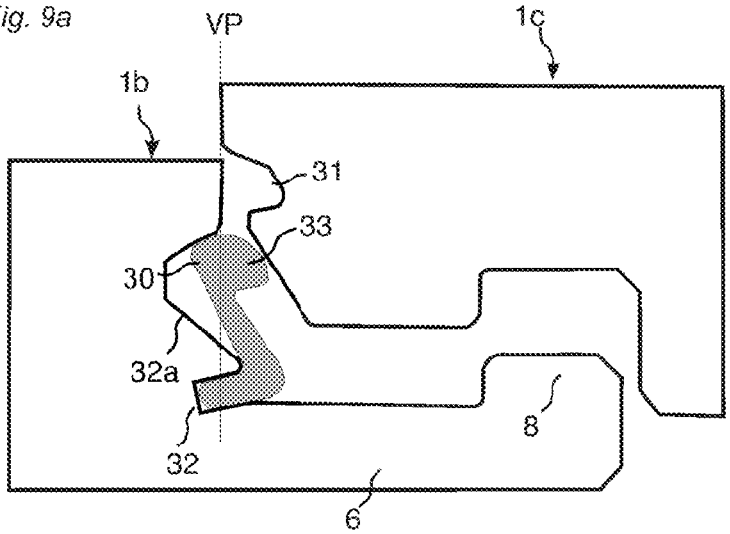
FIGS. 9*a*-9*c* illustrate a third embodiment of the invention.
Figure 9B:
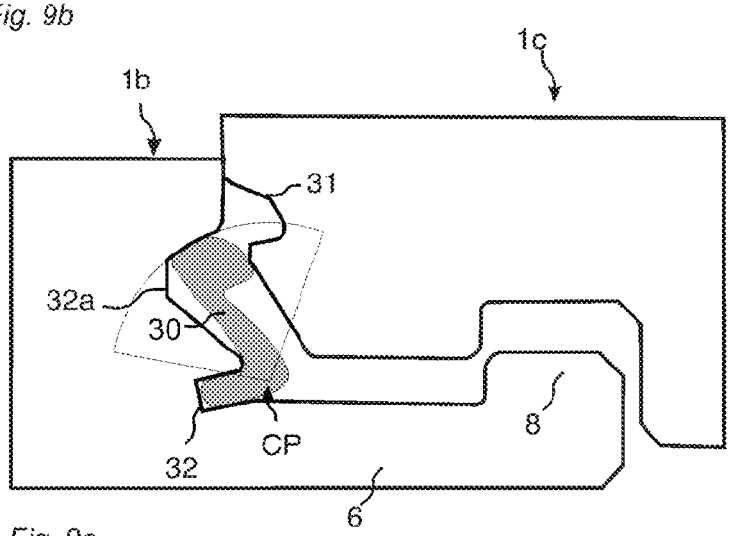
Figure 9C:
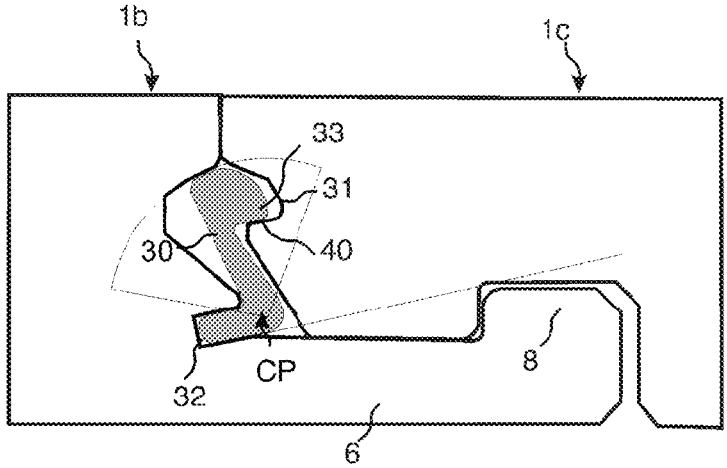

FIGS. 9*a*-9*c* show a preferred embodiment of a flexible tongue 30, which is connected in a fixed manner in a holding groove 32 of the strip panel 1*b* and comprises a flexible part 33 that is displaceable in a displacement groove 32*a*. Such an embodiment allows increased flexibility since the vertical distance between the lower part of the tongue that is connected in the holding groove 32 and the upper part 33 that locks against the locking surface 40 of the tongue groove 31, could be increased.

The flexible snap tab 33 is during folding displaced horizontally inwards and outwards in the displacement groove 32*a* and bending occurs preferably and essentially around a centre point C located in a lower part of the flexible tongue 30.

The holding groove 32 is located vertically below the displacement groove 32*a*. The locking surface 40 of the tongue groove 31 is preferably spaced vertically upwards in relation to the holding groove 32 and these two grooves are preferably located in different horizontal planes one over the other. The holding grove 32 is preferably located vertically below the upper part of the locking element 8 and is preferably inclined upwards in relation to a horizontal plane in order to facilitate the insertion of the flexible tongue 31 into the holding groove 32.

Such a flexible tongue could also be connected to an edge of the groove panel 1*c*. The holding groove 32 is in such an embodiment preferably located in the upper part of the panel edge and the displacement groove 32*a* below the holding groove 32.

Figure 10A:
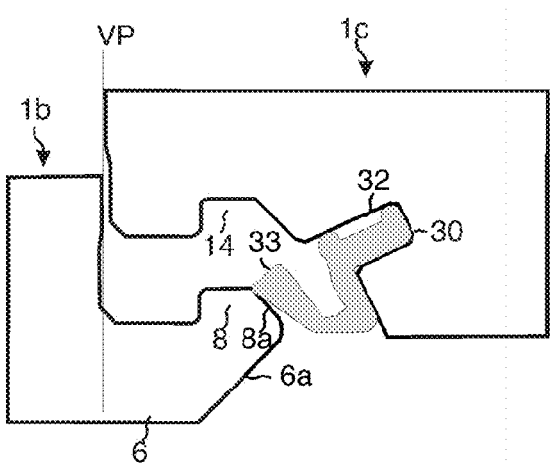
FIGS. 10*a*-10*c* illustrate a flexible tongue fixed to an edge of the fold panel.
Figure 10B:
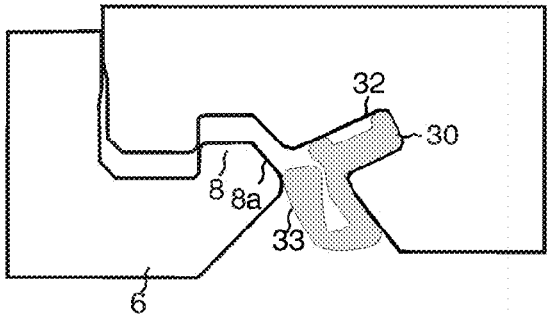
Figure 10C:
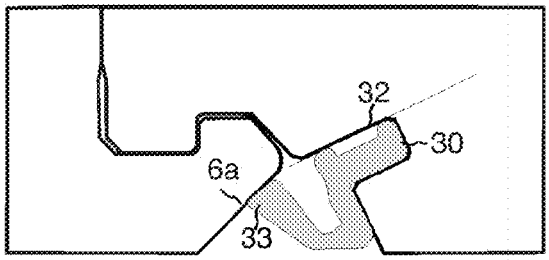

FIGS. 10*a*-10*c* show that a flexible tongue could be connected to a holding groove 32 in the groove panel 1*c* and that the holding groove 32 is spaced inwardly from the locking groove 14. The holding groove 32 could even in this embodiment preferably be inclined against the horizontal plane.

FIGS. 10*b* and 10*c* show that the flexible snap tab 33 during locking slides against the upper and outer part 8*a* of the locking element 8. This part 8*a* is in this embodiment inclined. It could for example also be rounded. The outer part 33 of the snap tab locks against a locking surface 6*a* formed on the outer part of the strip 6. This locking surface 6*a* could be inclined downwards or upward, essentially horizontal or rounded.

Figure 10D:
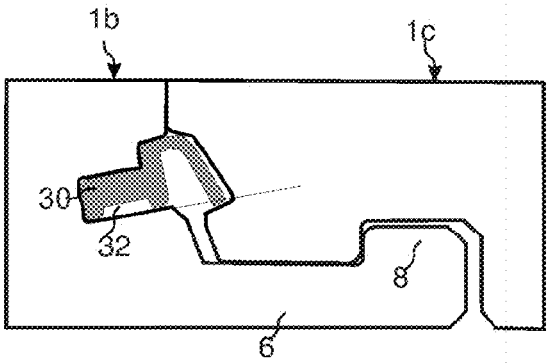
FIG. 10*d* illustrates a flexible tongue fixed in an inclined groove.

FIG. 10*d* shows that all embodiments shown in FIGS. 7 and 8 could be connected to a holding grove 32 that is inclined in order to facilitate the fixing of the flexible tongue 30 when a holding groove 32 is formed in the strip panel 1*b*.

The invention claimed is:

1. A set of floor panels which are mechanically connectable to each other along one pair of adjacent edges, so that upper joint edges of said floor panels in a connected state define a vertical joint plane, each of said floor panels comprising:

a flexible tongue on a second edge of the floor panel;

a locking element and a locking strip formed in one piece with the floor panel at a first edge and a locking groove at the opposite second edge, the locking strip being outside of the vertical joint plane beyond the upper joint edge of the first edge, and the locking groove being open towards a rear side of the floor panel that faces a subfloor;

the locking element and the locking groove form a horizontal mechanical connection perpendicular to the vertical joint plane, the locking element having a locking surface that is adapted to directly contact a locking surface of the locking groove for locking the floor panels to each other horizontally parallel to a horizontal plane and at right angles to the joined first and second edges;

the flexible tongue comprising resilient parts formed of a separate material than the core of the floor panels, and cooperates with a part of the locking strip for mechanically locking together said adjacent edges vertically parallel to the vertical joint plane and at right angles to the horizontal plane of the floor panels;

wherein two of the panels can be mechanically joined together by displacement of said two floor panels vertically towards each other, while at least a part of the flexible tongue, comprising a flexible snap tab extending upwards, is resiliently displaced substantially around a center point located at a lower part of the flexible tongue, to an inner position until said adjacent edges of the two floor panels are brought into engagement with each other vertically, and the flexible snap tab is displaced towards its initial position, and a distal end of the flexible snap tab is exposed to the subfloor in the connected state of the floor panels;

wherein the flexible tongue has an inner part mounted in a sideward open holding groove in the second edge that is open towards the vertical joint plane, and the inner part is fixed in the sideward open holding groove.

2. The set of floor panels as claimed in claim 1, wherein the inner part comprises one or several vertical cross sections and wherein at least one of said vertical cross sections is larger than a thickness of the flexible snap tab and/or another vertical cross section of the inner part.

3. The set of floor panels as claimed in claim 1, wherein the flexible tongue during locking is bent horizontally along at least one of the adjacent edges.

4. The set of floor panels as claimed in claim 1, wherein a part of the first edge and the flexible snap tab are configured such that the first contact point between the first edge and the flexible snap tab is located at an upper part of said flexible snap tab when the second edge is displaced along the vertical joint plane towards the first edge.

5. The set of floor panels as claimed in claim 1, wherein the flexible snap tab during locking is configured to slide against a part of the locking element.

6. The set of floor panels as claimed in claim 5, wherein the flexible snap tab during locking is configured to slide against an upper part of the locking element.

7. The set of floor panels as claimed in claim 5, wherein the flexible snap tab during locking is configured to slide against an outer part of the locking element.

8. The set of floor panels as claimed in claim 7, wherein the outer part of the locking element comprises a bevel.

9. The set of floor panels as claimed in claim 1, wherein the flexible tongue is made of extruded polymer material.

10. The set of floor panels as claimed in claim 1, wherein the center point is spaced from a lower part of the sideward open holding groove.

11. The set of floor panels as claimed in claim 1, wherein an outer part of the flexible snap tab locks against a locking surface formed on an outer part of the locking strip.

12. The set of floor panels as claimed in claim 11, wherein the locking surface is inclined upwards.

13. The set of floor panels as claimed in claim 11, wherein the locking surface is inclined downwards.

14. The set of floor panels as claimed in claim 11, wherein the locking surface is rounded.

15. The set of floor panels as claimed in claim 1, wherein the sideward open holding groove is inclined against the horizontal plane.

16. The set of floor panels as claimed in claim 1, wherein the center point is offset horizontally from the sideward open holding groove.

17. The set of floor panels as claimed in claim 1, wherein at least a part of the flexible tongue is disposed at a rear side of the floor panels.

18. The set of floor panels as claimed in claim 1, wherein the flexible snap tab locks against a locking surface formed on a lower part of the locking strip.

* * * * *